US006383085B1

(12) United States Patent
Tseng

(10) Patent No.: US 6,383,085 B1
(45) Date of Patent: May 7, 2002

(54) SWING ASSEMBLY WITH A CANOPY

(75) Inventor: Chuen-Jong Tseng, Chiayi Hsien (TW)

(73) Assignee: Shin Yeh Enterprise Co., Ltd., Chiayi Hsien (TW)

( * ) Notice: Subject to any disclaimer, the term of this patent is extended or adjusted under 35 U.S.C. 154(b) by 0 days.

(21) Appl. No.: 09/864,433

(22) Filed: May 24, 2001

(51) Int. Cl.[7] ..... A63G 9/12

(52) U.S. Cl. ..... 472/118; 472/125; 297/184.15; 5/128

(58) Field of Search ..... 472/118, 119, 472/120, 121, 122, 123, 124, 125; 297/273, 184.15; 5/113, 127, 128, 129, 130

(56) References Cited

U.S. PATENT DOCUMENTS 2,300,586 A * 11/1942 Meehan ..... 297/184.15
2,353,220 A * 7/1944 Charlop ..... 5/128
4,017,071 A * 4/1977 Wright ..... 472/118
4,865,381 A * 9/1989 Van Rogue ..... 135/909
4,898,198 A * 2/1990 Castlebury ..... 135/117
5,494,329 A * 2/1996 Gonzalez et al. ..... 135/88.01
5,803,818 A * 9/1998 Tseng ..... 384/273
5,842,741 A * 12/1998 Onorini ..... 297/281
5,938,283 A * 8/1999 Babcock et al. ..... 297/273
5,977,780 A * 11/1999 Herrmann ..... 324/634
6,001,021 A * 12/1999 Battaglia ..... 248/163.2

* cited by examiner

*Primary Examiner*—Kien T. Nguyen
(74) *Attorney, Agent, or Firm*—Ladas & Parry

(57) ABSTRACT

A swing assembly includes a support unit, a seat unit disposed among a pair of side frames and a horizontal bar of the support unit, linking units for connecting the seat unit to the horizontal bar, and a canopy unit having a pair of lateral canopy frames mounted on the support unit and a flexible canopy sheet spreading across and over the canopy frames. Each canopy frame includes a horizontal bottom rail transverse to the horizontal bar, and an upright main frame member disposed above and fastened to the bottom rail. The canopy sheet is formed with a pair of retaining sleeves that are sleeved respectively on the bottom rails of the canopy frames.

5 Claims, 6 Drawing Sheets

SWING ASSEMBLY WITH A CANOPY

BACKGROUND OF THE INVENTION

1. Field of the Invention

The present invention relates to a swing assembly, more particularly to a swing assembly including a pair of lateral canopy frames which can be easily assembled to a canopy sheet to form a canopy that is kept in a tensioned state.

2. Description of the Related Art

FIG. 1 illustrates a conventional swing assembly which includes a pair of spaced-apart side frames 11, a horizontal bar 12 extending between upper ends of the side frames 11, a seat unit 13 disposed among the side frames 11 and the horizontal bar 12 and suspended on the horizontal bar 12, and a canopy 14. The canopy 14 includes a rectangular canopy frame 140 mounted on upper ends 111 of the side frames 12. The canopy frame 140 is constituted by a pair of U-shaped rods 15 on lateral sides, and a pair of elongated rods 16 on front and rear sides. Each of the elongated rods 16 has restricted end sections 161, each of which extends into a respective tubular end of the U-shaped rods 15, as shown in FIG. 2. Before the elongated rods 16 are assembled to the U-shaped rods 15, each of the elongated rods 16 and the U-shaped rods 15 extends through a respective retaining sleeve 171 on a canopy sheet 17 for retaining the canopy sheet 17 on the canopy frame 140. The elongated rods 16 can be assembled to the U-shaped rods 15 only after the elongated rods 16 and the U-shaped rods 15 are sleeved with the retaining sleeves 171 of the canopy sheet 17. As such, the canopy sheet 17 is designed to have a size sufficient to permit insertion of the restricted end sections 161 of the elongated rods 16 into-the tubular ends of the U-shaped rods 15. Therefore, the canopy sheet 17 can hardly be kept in a tensioned state after assembly. The appearance of the canopy 14 is not satisfactory. Moreover, rain could accumulate on top of the canopy sheet 17 to ultimately result in collapse or breakage of the canopy 14.

SUMMARY OF THE INVENTION

Therefore, the main object of the present invention is to provide a swing assembly including a pair of lateral canopy frames which can be easily assembled to a canopy sheet to form a canopy that is kept in a tensioned state.

Accordingly, the swing assembly of the present invention includes a support unit, a seat unit, a pair of linking units, and a canopy unit. The support unit includes a pair of spaced-apart side frames with lower end portions adapted to be supported on a ground surface, and upper end portions, and a horizontal bar extending between and interconnecting the upper end portions of the side frames. The seat unit is disposed among the side frames and the horizontal bar. The linking units are spaced-apart along a longitudinal direction of the horizontal bar. Each of the linking units has an upper end connected pivotally to the horizontal bar, and a lower end connected pivotally to the seat unit, thereby suspending the seat unit above the ground surface. The canopy unit includes a pair of lateral canopy frames which are spaced-apart in the longitudinal direction, and a flexible canopy sheet. Each of the canopy frames includes a horizontal bottom rail transverse to the horizontal bar, and an upright main frame member which is disposed above the bottom rail and which extends in a direction along the length of the bottom rail. The main frame member is fastened to the bottom rail, and is mounted on the upper end portion of a respective one of the side frames of the support unit. The canopy sheet spreads across and over the canopy frames, and has a surface which confronts the canopy frames and which is formed with a pair of retaining sleeves that are sleeved respectively on the bottom rails of the canopy frames.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
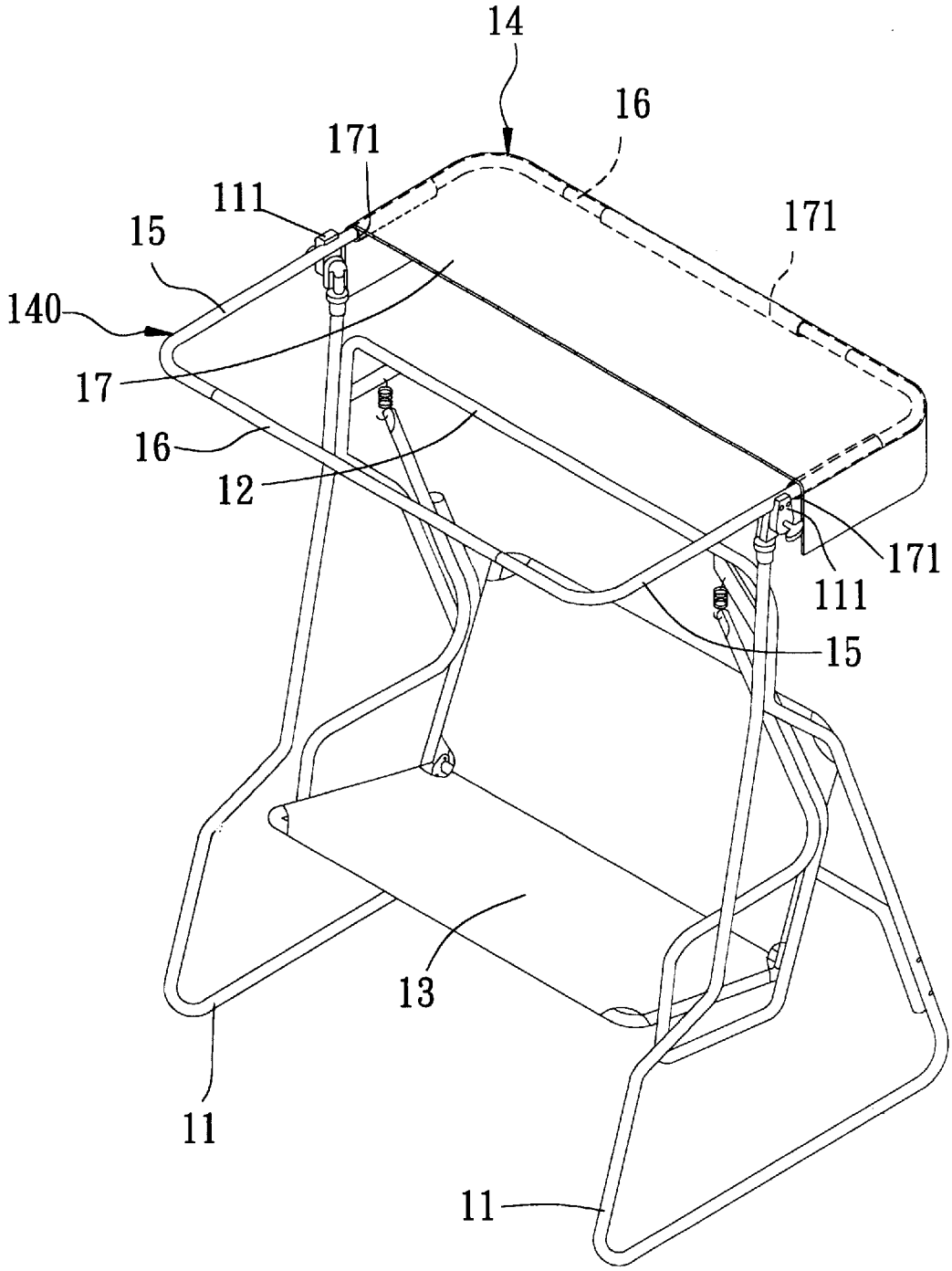
FIG. 1 PRIOR ART
FIG. 1 is a perspective view of a conventional swing assembly, where a canopy sheet is shown to be partly-sectioned.
Figure 2:
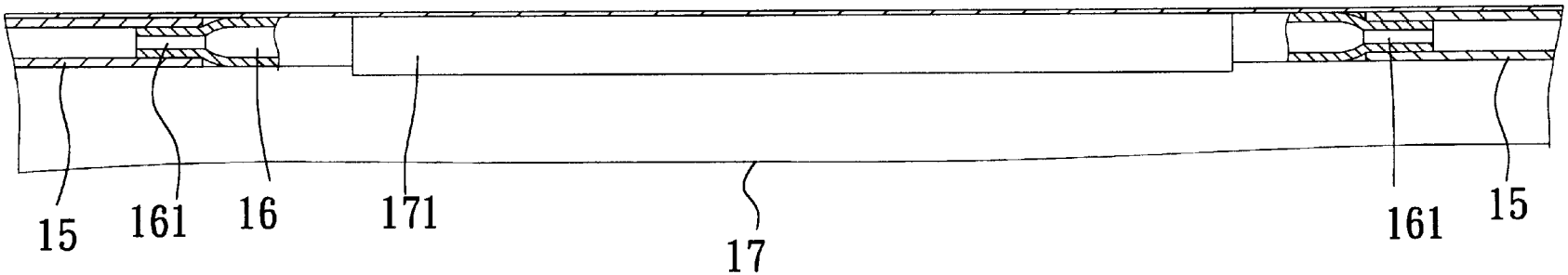
FIG. 2 PRIOR ART
FIG. 2 is a fragmentary sectional view showing a canopy frame of the conventional swing assembly.
Figure 3:
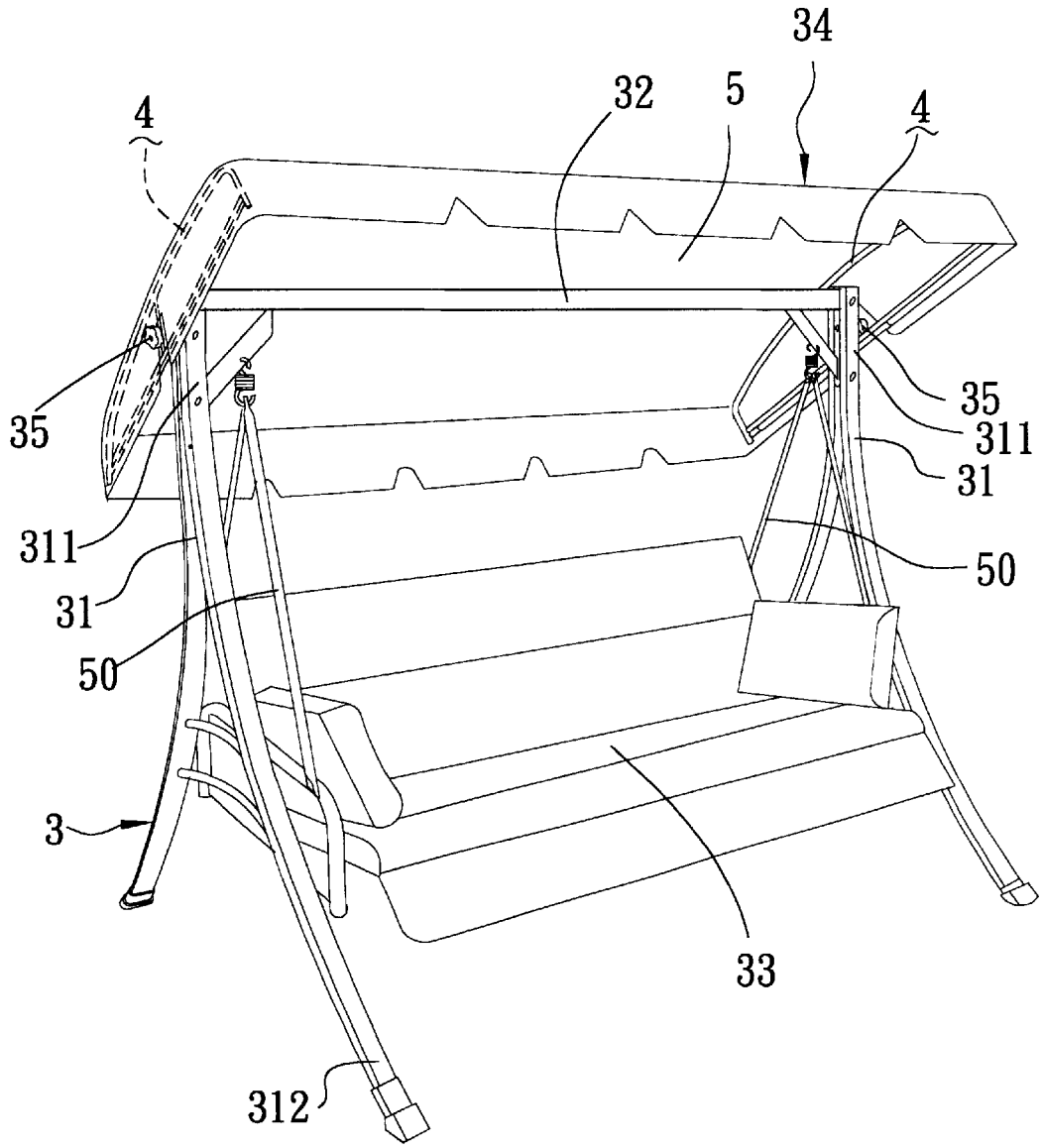
FIG. 3 is a perspective view of a preferred embodiment of the swing assembly of the present invention.

Referring to FIG. 3, the preferred embodiment of the swing assembly according to the present invention is shown to include a support unit 3, a seat unit 33, a pair of linking units 50, and a canopy unit 34.

The support unit 3 includes a pair of spaced-apart upright side frames 31 with lower end portions 312 adapted to be supported on a ground surface, and upper end portions 311, and a horizontal bar 32 extending between and interconnecting the upper end portions 311 of the side frames 31. The seat unit 33 is disposed among the side frames 31 and the horizontal bar 32. The linking units 50 are spaced-apart along a longitudinal direction of the horizontal bar 32. Each of the linking units 50 has an upper end connected pivotally to the horizontal bar 32, and a lower end connected pivotally to the seat unit 33, thereby suspending the seat unit 33 swingably above the ground surface.

Figure 4:
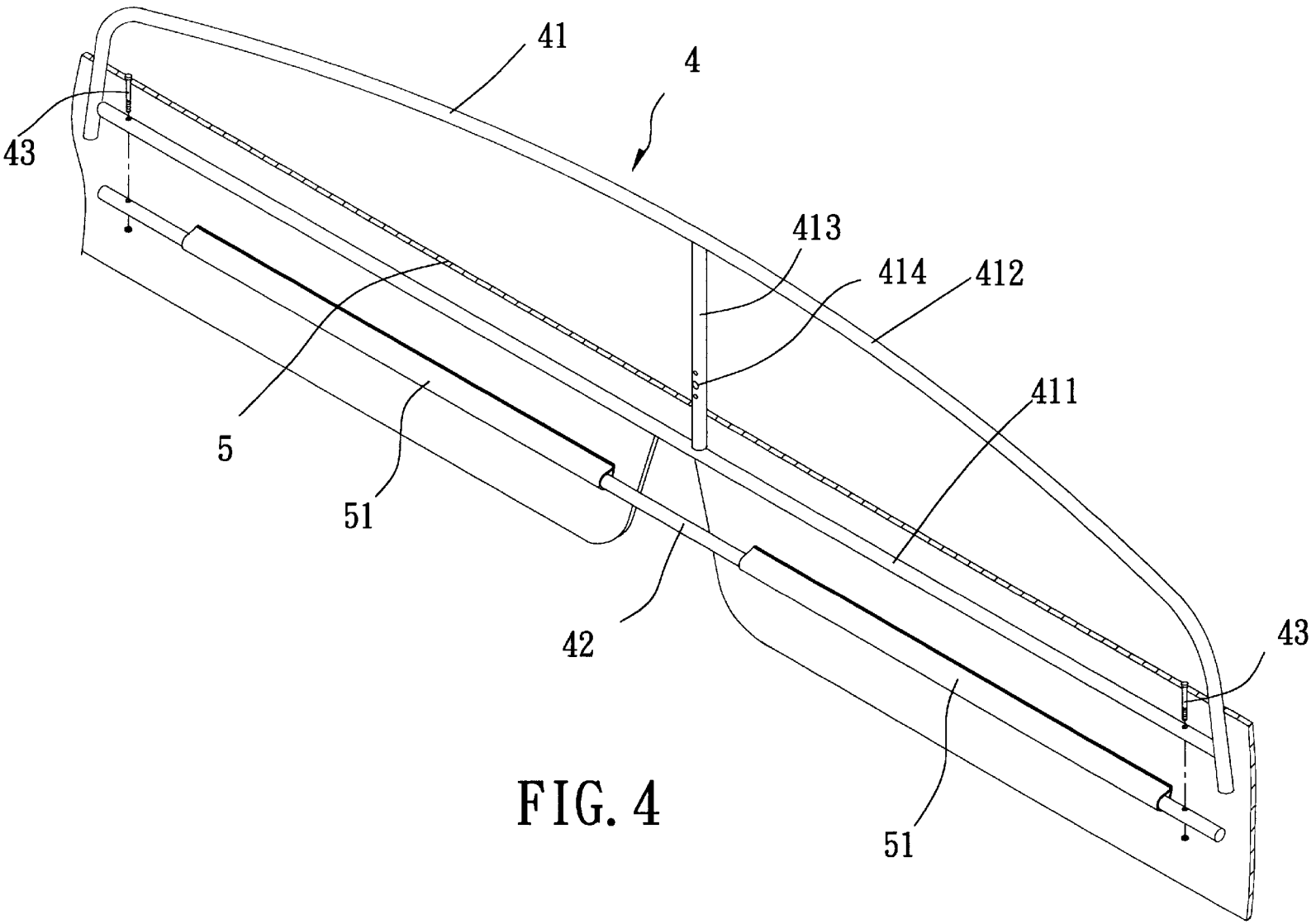
FIG. 4 is a fragmentary exploded perspective view of a canopy unit of the preferred embodiment, where the canopy unit is shown to be detached from a support unit of the swing assembly.
Figure 5:
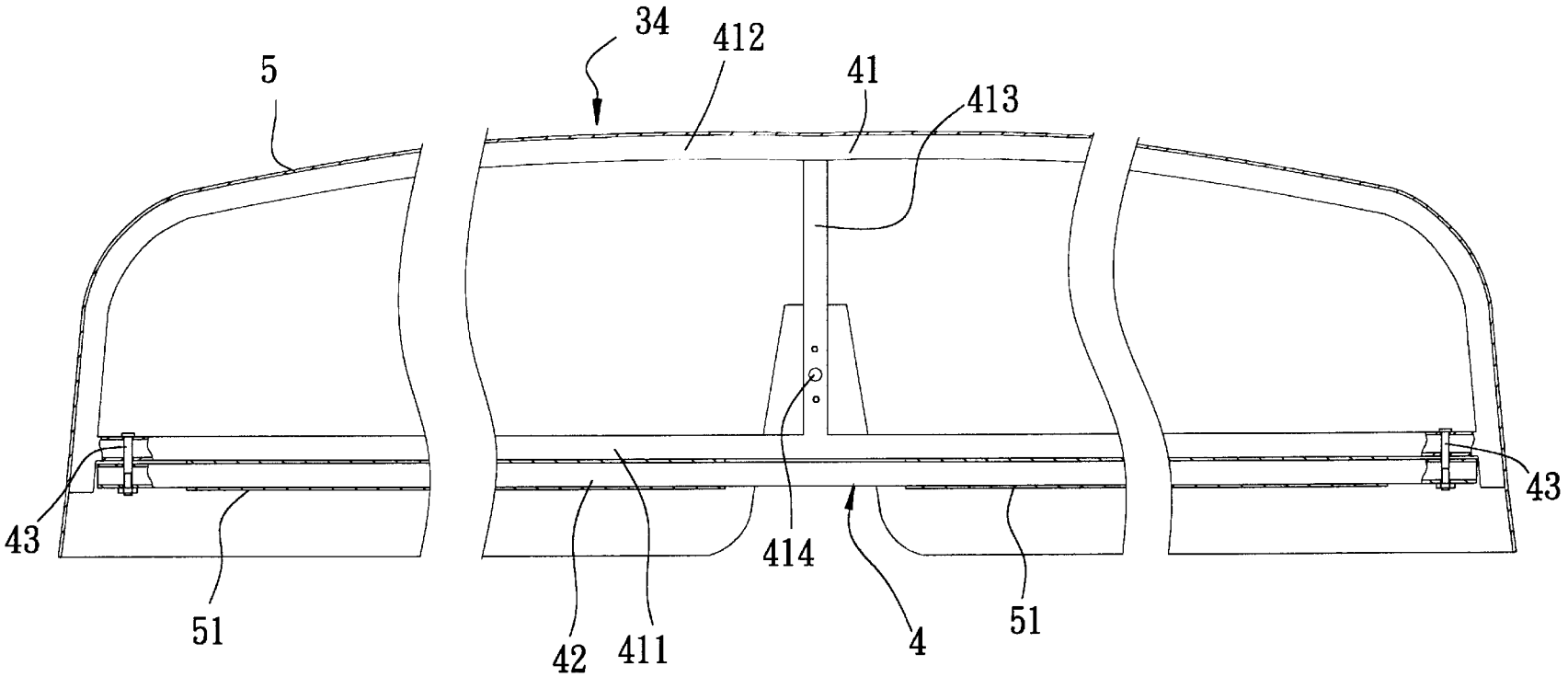
FIG. 5 is a schematic partly sectional view showing the canopy unit of the preferred embodiment, where the canopy unit is shown to be detached from the support unit of the swing assembly.

Referring to FIGS. 3 to 5, the canopy unit 34 includes a pair of lateral canopy frames 4 which are spaced-apart along a longitudinal direction of the horizontal bar 32, and a flexible canopy sheet 5 spreading across and over the canopy frames 4. Each of the canopy frames 4 includes a horizontal bottom rail 42, and an upright main frame member 41 disposed above the bottom rail 42. The bottom rail 42 extends in a front-to-rear direction transverse to the horizontal bar 32. The main frame member 41 includes an upwardly curving upper rod 412 with two opposite ends which extend downwardly, a horizontal lower rod 411 extending between the opposite ends of the upper rod 412, and an upright mounting rod 413 extending between intermediate sections of the upper and lower rods 412, 411 to interconnect the same. The lower rod 411 is disposed immediately over the bottom rail 42, and is parallel to the bottom rail 42. The lower rod 411 has a length substantially equal to that of the bottom rail 42, and has two opposite ends fastened to the bottom rail 42 by means of a pair of vertically extending screw fasteners 43.

The canopy sheet 5 is in the form of a flexible cloth, and has an inner side surface that confronts the canopy frames 4 and that is formed, such as by sewing, with two pairs of retaining sleeves 51. The retaining sleeves 51 of each pair are aligned axially and are sleeved on a respective one of the bottom rails 42.

Figure 6:
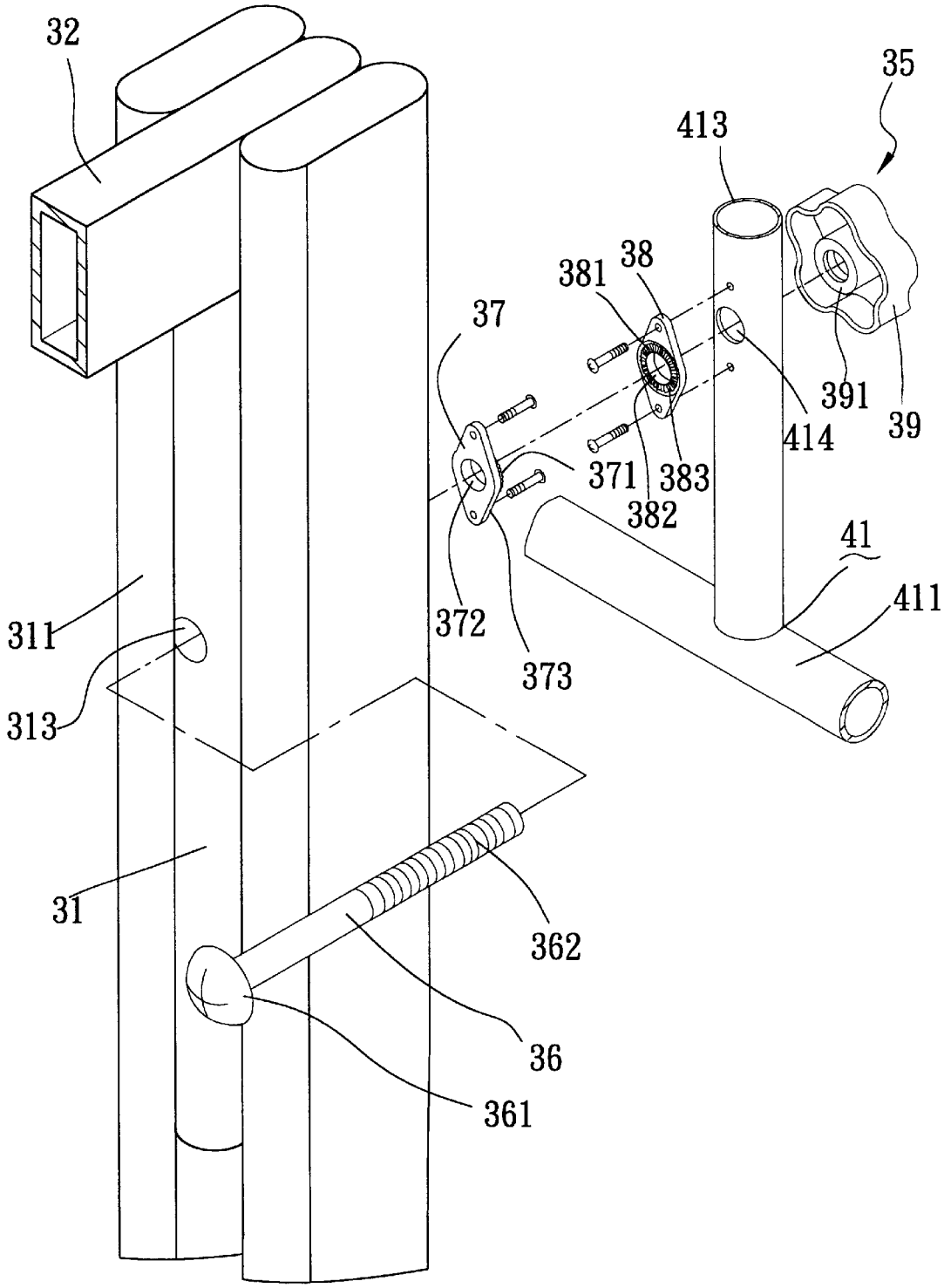
FIG. 6 is a fragmentary exploded perspective view showing an adjustable mounting unit for mounting the canopy unit on a support unit of the swing assembly.

The canopy unit 34 is mounted on the upper end portions 311 of the side frames 31 by means of a pair of adjustable mounting units 35. Referring to FIG. 6, the upper end portion 311 of each of the side frames 31 is formed with a first mounting hole 313. The mounting rod 413 of the main frame member 41 of each of the canopy frames 4 is formed with a second mounting hole 414 aligned with the first mounting hole 313. Each of the mounting units 35 includes a stationary seat 37 secured to the upper end portion 311 of a respective one of the side frames 31, a rotary seat 38 secured to the mounting rod 413 of a respective one of the canopy frames 4, a pivot axle 36, and a rotary knob 39.

The stationary seat 37 is formed with a first axle hole 372 therethrough, and has a first end face 373 formed with a series of first engagement teeth 371 around the first axle hole 372. The rotary seat 38 is formed with a second axle hole 382 therethrough, and has a second end face 383 that confronts the first end face 373 of the stationary seat 37 and that is formed with a series of second engagement teeth 381 around the second axle hole 382 for engaging the first engagement teeth 371. The first and second axle holes 372, 382 are aligned with each other, and are further aligned with the first and second mounting holes 313, 414. The pivot axle 36 extends through the first mounting hole 313, the first and second axle holes 372, 382, and the second mounting hole 414, and has a first end 361 retained at the first mounting hole 313, and a threaded second end 362 opposite to the first end 361 and extending through the second mounting hole 414 in the mounting rod 413. The rotary knob 39 is disposed adjacent to the mounting rod 413, and is formed integrally with a nut 391 which engages threadedly the threaded second end 362 of the pivot axle 36.

During assembly of the canopy unit 34 to the support unit 3, the headed first end 361 of the pivot axle 36 of each of the adjustable mounting unit 35 is pushed against the upper end portion 311 of the respective side frame 31 by hand or with the use of a tool to prevent rotation of the pivot axle 36. Then, the rotary knob 39 is operated in a first direction for threading toward the mounting rod 413 to push the mounting rod 413 toward the respective side frame 31 to enable the second end face 383 of the rotary seat 38 to contact tightly the first end face 373 of the stationary seat 37 so as to ensure engagement between the first and second engagement teeth 371, 381, thereby preventing rotation of the rotary seat 38 together with the canopy frame 4 relative to the respective side frame 31, and thereby positioning the canopy unit 34 on the support unit 3.

To adjust the inclination of the canopy unit 34, the headed first end 361 of the pivot axle 36 of each of the adjustable mounting units 35 is once again pushed against the upper end portion 311 of the respective side frame 31 in the manner described beforehand to prevent rotation of the pivot axle 36. The rotary knobs 39 are then operated in a second direction opposite to the first direction for threading away from the mounting rods 413 of the canopy frames 4. At this time, the second engagement teeth 381 are released from the first engagement teeth 371. The canopy unit 34 is then rotated to cause rotation of the rotary seats 38 about the pivot axles 36 relative to the stationary seats 37. When the canopy unit 34 is adjusted to a desired tilt or inclination, the rotary knobs 39 are operated once again in the first direction, as described in the previous paragraph, to once again engage the rotary seats 38 with the stationary seats 37.

Alternatively, an engagement mechanism may be provided between the headed first end 361 of the pivot axle 36 and the first mounting hole 313 of the respective side frame 31 to prevent rotation of the pivot axle 36 within the first mounting hole 313. In this case, the use of a tool is not required during operation of the adjustable mounting units 35.

During assembly of the canopy frames 4 to the canopy sheet 5, the bottom rails 42 are inserted respectively through the retaining sleeves 51 of the canopy sheet 5. Then, the main frame members 41 are brought below the canopy sheet 5 and above the bottom rails 42, and are fastened to the bottom rails 42 using the screw fasteners 43 to complete assembly of the canopy unit 34. At this time, the canopy sheet 5 is tensioned by the upwardly curving upper rods 412 of the main frame members 41. Finally, the assembled canopy unit 34 is mounted on the upper end portions 311 of the side frames 31 by means of the adjustable mounting units 35.

It has thus been shown that, in the swing assembly of the present invention, the canopy frames 4 can be easily assembled to the canopy sheet 5. The canopy sheet 5 can be designed to have a suitable size that is sufficient to enable easy assembly of the canopy frames 4 to the canopy sheet 5 while permitting the canopy sheet 5 to be kept in a tensioned state after assembly.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A swing assembly comprising:

a support unit including a pair of spaced-apart side frames with lower end portions adapted to be supported on a ground surface, and upper end portions, and a horizontal bar extending between and interconnecting said upper end portions of said side frames;

a seat unit disposed among said side frames and said horizontal bar;

a pair of linking units spaced-apart along a longitudinal direction of said horizontal bar, each of said linking units having an upper end connected pivotally to said horizontal bar, and a lower end connected pivotally to said seat unit, thereby suspending said seat unit above the ground surface; and a canopy unit including:

a pair of lateral canopy frames which are spaced-apart in the longitudinal direction, each of said canopy frames including a horizontal bottom rail transverse to said horizontal bar, and an upright main frame member which is disposed above said bottom rail and which extends in a direction along length of said bottom rail, said main frame member being fastened to said bottom rail and being mounted on said upper end portion of a respective one of said side frames of said support unit, and a flexible canopy sheet spreading across and over said canopy frames, said canopy sheet having a surface which confronts said canopy frames and which is formed with a pair of retaining sleeves that are sleeved respectively on said bottom rails of said canopy frames.

2. The swing assembly as claimed in claim 1, wherein said main frame member of each of said canopy frames includes an upwardly curving upper rod, a horizontal lower rod parallel to and fastened to the respective one of said bottom rails, and an upright mounting rod extending between and interconnecting said upper and lower rods, said upright mounting rod being mounted on the respective one of said side frames.

3. The swing assembly as claimed in claim 1, further comprising a pair of adjustable mounting units for mounting said canopy frames on said upper end portions of said side frames, respectively, so as to permit tilting adjustment of said canopy frames with respect to said side frames.

4. The swing assembly as claimed in claim 3, wherein each of said canopy frames includes a mounting rod, each of said adjustable mounting units including a stationary seat secured to said upper end portion of the respective one of said side frames, said stationary seat having a first axle hole formed therethrough, and a first end face that is formed with a series of first engagement teeth around said first axle hole;

a rotary seat secured to said mounting rod of the respective one of said canopy frames, said rotary seat having a second axle hole formed therethrough and aligned with said first axle hole, and a second end face that confronts said first end face and that is formed with a series of second engagement teeth around said second axle hole for engaging said first engagement teeth;

a pivot axle extending in a direction parallel to said horizontal bar and extending through said upper end portion of the respective one of said side frames, said first and second axle holes and said mounting rod of the respective one of said canopy frames, said pivot axle having a first end engaging said upper end portion of the respective one of said side frames, and a threaded second end extending through said mounting rod of the respective one of said canopy frames; and an operable rotary knob disposed adjacent to said mounting rod of the respective one of said canopy frames and threadedly engaging said second end of said pivot axle, said rotary knob being operable in a first direction for threading toward said mounting rod to push said mounting rod toward said upper end portion of the respective one of said side frames so as to enable said second end face of said rotary seat to contact tightly said first end face of said stationary seat and to enable said first engagement teeth to engage said second engagement teeth, thereby preventing rotation of said rotary seat relative to said stationary seat about an axis of said pivot axle to prevent rotation of said canopy frames relative to said side frames of said support unit, said rotary knob being further operable in a second direction opposite to the first direction for threading away from said mounting rod, thereby releasing said second engagement teeth of said rotary seat from said first engagement teeth of said stationary seat, and thereby permitting rotation of said rotary seat together with the respective one of said canopy frames relative to said stationary seat and the respective one of said side frames so as to permit tilting adjustment of said canopy unit.

5. The swing assembly as claimed in claim 4, wherein said main frame member of each of said canopy frames includes an upwardly curving upper rod, and a horizontal lower rod parallel to and fastened to the respective one of said bottom rails, said mounting rod extending between and interconnecting said upper and lower rods.

* * * * *